US008052466B2

(12) United States Patent
Okamoto

(10) Patent No.: US 8,052,466 B2
(45) Date of Patent: Nov. 8, 2011

(54) OUTER CONDUCTOR TERMINAL

(75) Inventor: Ryoya Okamoto, Yokkaichi (JP)

(73) Assignees: Autonetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 113 days.

(21) Appl. No.: 12/312,023

(22) PCT Filed: May 14, 2008

(86) PCT No.: PCT/JP2008/058804

§ 371 (c)(1), (2), (4) Date: Apr. 23, 2009

(87) PCT Pub. No.: WO2008/140092

PCT Pub. Date: Nov. 20, 2008

(65) Prior Publication Data

US 2010/0221949 A1 Sep. 2, 2010

(30) Foreign Application Priority Data

May 15, 2007 (JP) ..... 2007-128876

(51) Int. Cl.
*H01R 9/05* (2006.01)

(52) U.S. Cl. ..... 439/585

(58) Field of Classification Search ..... 439/585, 439/578, 583, 607.01, 607.43, 603.38, 607.54, 439/607.44
See application file for complete search history.

(56) References Cited

U.S. PATENT DOCUMENTS

2005/0266727 A1 12/2005 Yamaguchi et al.

FOREIGN PATENT DOCUMENTS

| | | |
|---|---|---|
| JP | U-56-119264 | 9/1981 |
| JP | A-2001-217013 | 8/2001 |
| JP | A-2005-093173 | 4/2005 |

*Primary Examiner* — Alexander Gilman
(74) *Attorney, Agent, or Firm* — Oliff & Berridge, PLC

(57) ABSTRACT

An outer conductor terminal by which productivity of the outer conductor terminal having crimping portions provided with reticulated knurling grooves on the inner surfaces can be improved. An outer conductor terminal of a shielded connector is provided with a pair of shielded conductor crimping portions to be crimped onto a shielded conductor which is exposed by stripping a sheath at an end of a shielded cable. The shielded conductor crimping portions are crimped such that the shielded conductor crimping portion overlaps the shielded conductor crimping portion. Reticulated knurling grooves are formed on the inner surfaces of the shielded conductor crimping portions, but they are not formed on an overlapping portion of the inner surface of the shielded conductor crimping portion which is placed on the shielded conductor crimping portion.

3 Claims, 5 Drawing Sheets

OUTER CONDUCTOR TERMINAL

TECHNICAL FIELD

The present invention relates to a wiring harness of an automobile and more particularly to an outer conductor terminal of a shielded connector to be connected to a shielded cable such as a coaxial cable.

BACKGROUND ART

In recent years, speed of electric signals has been increased (frequencies of electric signals have been made higher) which are transmitted to a control printed circuit board which is embedded in an electronic device of an automobile such as a car navigation system and on which components such as an electronic component and an IC (an integrated circuit) are mounted. In addition, patterns of printed circuit boards have become denser. Generally, a high-frequency shielded cable is used to transmit such high-frequency electric signals, and along with the increase in frequencies of electric signals, demand for a high-frequency, compact shielded connector, which is connected to an end of the shielded cable, has been increased.

One type of shielded cable which is known as a coaxial cable generally has a coaxial structure which comprises: a signal wire comprising a conductor which is used as a transmission path of electric signals and composed of a plurality of metal elemental wires tied into a bundle, and an insulator covering the outer surface of the conductor; a braid defining a shielded conductor which covers the outer surface of the signal wire and is composed of a plurality of elemental wires; and an insulating sheath covering the outer surface of the shielded conductor. The shielded conductor covers the outer surface of the conductor leaving no clearance to electromagnetically shield the conductor.

Generally, a shielded connector to be connected to an end of the shielded cable which transmits high-frequency signals is provided with an inner conductor terminal to be connected to the conductor which transmits high-frequency signals, an outer conductor terminal to be connected to the shielded conductor such as the braid and arranged to cover the outer surface of the inner conductor terminal to electromagnetically shield the inner conductor terminal, and a dielectric having a predetermined dielectric constant which is provided between the inner conductor terminal and the outer conductor terminal. The inner conductor terminal and the outer conductor terminal are electronically connected to the conductor and the shielded conductor of the shielded cable respectively.

An example of a conventional shielded connector is disclosed in Japanese Patent Application Unexamined Publication No. 2005-93173. In this type of shielded connector, when connecting an inner conductor terminal and an outer conductor terminal to portions of a conductor and a shielded conductor of a coaxial cable which are exposed by stripping an insulator and a sheath, first a crimp section of the inner conductor terminal of the shielded connector is crimped onto the exposed conductor. Then, the inner conductor terminal is inserted and secured in a dielectric which is prearranged inside the outer conductor terminal of the shielded connector, and the shielded conductor is placed on a crimp section of the outer conductor terminal. The crimp section of the outer conductor terminal is then crimped onto the shielded conductor and the sheath to complete the connection.

The inner surfaces of shielded conductor crimping portions and sheath crimping portions of the outer conductor terminal according to Japanese Patent Application Unexamined Publication No. 2005-93173 are provided with reticulated knurling grooves. A braid defining the shielded conductor is pressed into the reticulated knurling grooves formed on the shielded conductor crimping portions, thereby improving fixing strength between the shielded conductor and the shielded conductor crimping portions. Similarly, the sheath is pressed into the reticulated knurling grooves formed on the sheath crimping portions, thereby improving fixing strength between the sheath and the sheath crimping portions. Generally, such reticulated knurling grooves are formed by applying press work to the outer conductor terminal before bending it.

DISCLOSURE OF THE INVENTION

Problem to be Solved by the Invention

If the reticulated knurling grooves are formed on the entire inner surfaces of the crimping portions as disclosed in Japanese Patent Application Unexamined Publication No. 2005-93173, a burr may occur on portions such as the tips of the crimping portions and damage the shielded conductor or sheath. In addition, there are problems such as an increase in the cost of a die used in the press work to provide the reticulated knurling grooves and inferior productivity in the press work.

Hence, the present invention aims to provide an outer conductor terminal which can improve productivity of the outer conductor terminal having crimping portions provided with reticulated knurling grooves on the inner surfaces.

Means for Solving Problem

An object of the invention is to overcome the problems described above and to provide an outer conductor terminal of a shielded connecter to be connected to an end of a shielded cable having a shielded conductor which covers the outer surface of a signal wire and a sheath which covers the outer surface of the shielded conductor, which comprises first and second shielded conductor crimping portions arranged to be crimped onto the shielded conductor which is exposed by stripping the sheath at the end of the shielded cable, wherein the shielded conductor crimping portions are crimped such that the second shielded conductor crimping portion overlaps the first shielded conductor crimping portion, and reticulated knurling grooves formed on inner surfaces of the first and second shielded conductor crimping portions, wherein the reticulated knurling grooves are not formed on an overlapping portion of the inner surface of the second shielded conductor crimping portion which is placed on the first shielded conductor crimping portion.

It is preferable that the outer conductor terminal comprises a tapered surface formed on the outer surface at the tip of the first shielded conductor crimping portion, and a tapered surface formed on the inner surface at the tip of the second shielded conductor crimping portion, which can slide on the tapered surface of the first shielded conductor crimping portion, and the reticulated knurling grooves are not formed on a portion of the inner surface of the second shielded conductor crimping portion which corresponds to the tapered surface of the outer surface of the first shielded conductor crimping portion.

In addition, it is preferable that the outer conductor terminal further comprises first and second sheath crimping portions to be crimped onto the sheath, wherein the first and second sheath crimping portions are crimped such that the second sheath crimping portion overlaps the first sheath crimping portion, and reticulated knurling grooves formed on inner surfaces of the first and second sheath crimping portions, wherein the reticulated knurling grooves are not formed on an overlapping portion of the inner surface of the second sheath crimping portion which is placed on the first sheath crimping portion.

Further, it is preferable that the outer conductor terminal further comprises a tapered surface formed on an outer surface at a tip of the first sheath crimping portion, and a tapered surface formed on an inner surface at a tip of the second sheath crimping portion, which can slide on the tapered surface of the first sheath crimping portion, wherein the reticulated knurling grooves are not formed on a portion of the inner surface of the first sheath crimping portion which corresponds to the tapered surface of the outer surface of the first sheath crimping portion.

Effect of the Invention

The outer conductor terminal has the configuration in which the first and second shielded conductor crimping portions are provided to be crimped onto the shielded conductor which is exposed by stripping the sheath at the end of the shielded cable, the shielded conductor crimping portions are crimped such that the second shielded conductor crimping portion overlaps the first shielded conductor crimping portion, reticulated knurling grooves formed on the inner surfaces of the first and second shielded conductor crimping portions, the reticulated knurling grooves are not formed on an overlapping portion of the inner surface of the second shielded conductor crimping portion which is placed on the first shielded conductor crimping portion. The area on which the reticulated knurling grooves are formed is thus decreased as compared with that in a case where the reticulated knurling grooves are formed on the entire inner surfaces of the shielded conductor crimping portions as with a conventional art. Accordingly, it is possible to suppress an increase in the cost of a die used in press work to form the reticulated knurling grooves on the shielded conductor crimping portions, and to decrease pressing pressure in the press work, thereby producing favorable effects such as better uniformity in the shape of reticulated knurling grooves, which result in improved productivity. In addition, occurrence of a burr can be suppressed in portions such as the tips of the shielded conductor crimping portions, thereby preventing the shielded conductor from being damaged.

Owing to the configuration in which the outer conductor terminal comprises the tapered surface formed on the outer surface at the tip of the first shielded conductor crimping portion, a tapered surface formed on the inner surface at the tip of the second shielded conductor crimping portion, which can slide on the tapered surface of the outer surface of the first shielded conductor crimping portion, wherein the reticulated knurling grooves are not formed on the portion of the inner surface of the first shielded conductor crimping portion which corresponds to the tapered surface of the outer surface of the first shielded conductor crimping portion, the area of the reticulated knurling grooves is further decreased by the area of the tapered surface. By not forming the reticulated knurling grooves on the portion corresponding to the tapered surface, when the tapered surfaces at the tips of the shielded conductor crimping portions come into contact with each other, they can smoothly slide without being caught. Accordingly, productivity in the crimping process can be improved.

In addition, owing to the configuration in which the outer conductor terminal further comprises the first and second sheath crimping portions to be crimped onto the sheath, wherein the first and second sheath crimping portions are crimped such that the second sheath crimping portion overlaps the first sheath crimping portion, and reticulated knurling grooves formed on the inner surfaces of the first and second sheath crimping portions, wherein the reticulated knurling grooves are not formed on the overlapping portion of the inner surface of the second sheath crimping portion which is placed on the first sheath crimping portion, the area on which the reticulated knurling grooves are formed is decreased as compared with that in a case where the reticulated knurling grooves are formed on the entire inner surfaces of the sheath crimping portions as with a conventional art. Accordingly, it is possible to suppress an increase in the cost of a die used in press work to form the reticulated knurling grooves on the sheath crimping portions, and to decrease pressing pressure in the press work, thereby producing favorable effects such as better uniformity in the shape of the reticulated knurling grooves, which result in improved productivity. In addition, occurrence of a burr can be suppressed in portions such as the tips of the sheath crimping portions, thereby preventing the sheath from being damaged.

Further, owing to the configuration in which the outer conductor terminal further comprises a tapered surface formed on the outer surface at the tip of the first sheath crimping portion, and a tapered surface formed on the inner surface at the tip of the second sheath crimping portion, which can slide on the tapered surface of the first sheath crimping portion, wherein the reticulated knurling grooves are not formed on the portion of the inner surface of the first sheath crimping portion which corresponds to the tapered surface of the outer surface of the first sheath crimping portion, the area of the reticulated knurling grooves is further decreased by the area of tapered surface. By not forming the reticulated knurling grooves on the portion which corresponds to the tapered surface, when the tapered surfaces on the tips of the sheath crimping portions come into contact with each other, they can smoothly slide without being caught. Accordingly, productivity in the crimping process can be improved.

BRIEF DESCRIPTION OF THE DRAWINGS

FIG. 1A is an external perspective view of the shielded connector viewed from behind and to the right, while FIG. 1B is an external perspective view of the shielded connector viewed from behind and to the left.

BEST MODE FOR CARRYING OUT THE INVENTION

A detailed description of a preferred embodiment of an outer conductor terminal embodied by the present invention is provided below with reference to the accompanying drawings. In the description, an outer conductor terminal according to the preferred embodiment of the present invention is described which is used for a coaxial cable having one signal wire comprising a conductor and an insulator covering the outer surface of the conductor. In addition, the side of the outer conductor terminal to which a corresponding shielded connector (not shown) is fitted is referred to as the front side in the description.

Figure 1A:
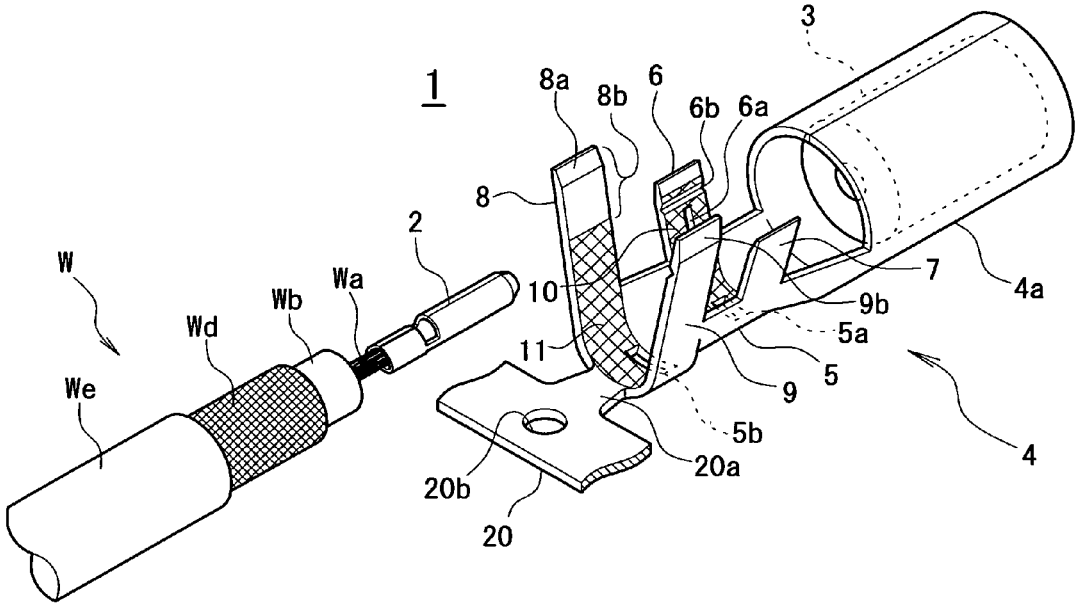
FIGS. 1A and 1B are external perspective views showing a shielded connector having an outer conductor terminal according to a preferred embodiment of the present invention.
Figure 1B:
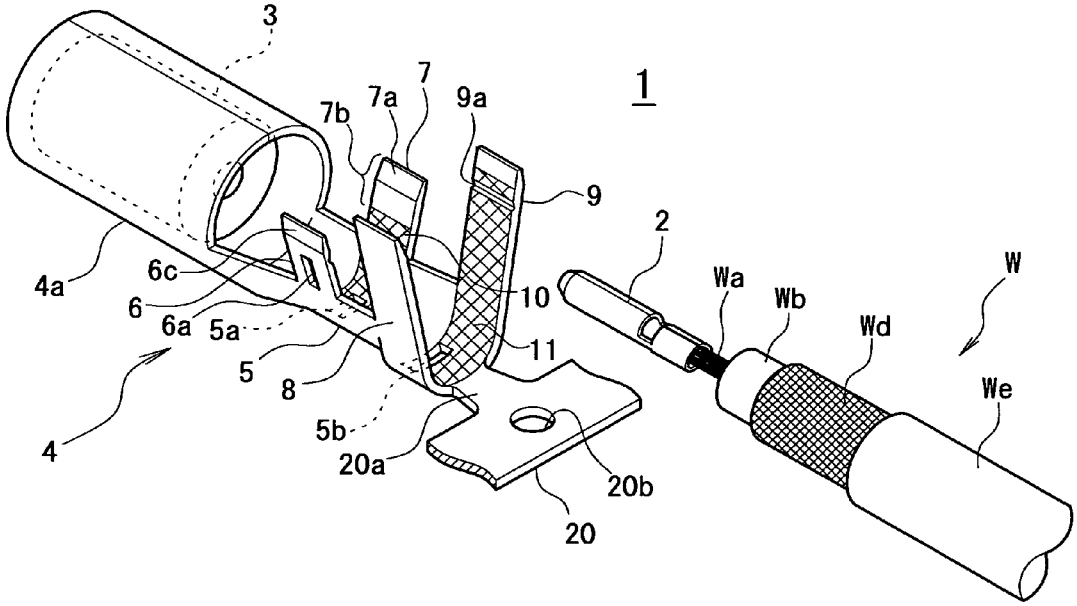

FIGS. 1A and 1B are external perspective views showing a shielded connector 1 having an outer conductor terminal according to a preferred embodiment of the present invention and a coaxial cable W in a state before they are subjected to a crimping process. FIG. 1A is an external perspective view of the shielded connector 1 viewed from behind and to the right, while FIG. 1B is an external perspective view of the shielded connector 1 viewed from behind and to the left.

As shown in FIGS. 1A and 1B, the shielded connector 1 to be connected to an end of the coaxial cable W comprises an inner conductor terminal 2, a dielectric 3, and an outer conductor terminal 4. The coaxial cable W has a coaxial structure comprising a conductor Wa which is a stranded wire of a plurality of elemental metal wires and used as a transmission path of electric signals, a braid defining a shielded conductor Wd which is braided using a plurality of elemental metal wires, an insulator Wb interposed between the conductor Wa and the shielded conductor Wd, and an insulating sheath We covering the outer surface of the shielded conductor Wd.

The inner conductor terminal 2 is connected to the conductor Wa of the coaxial cable W to transmit high-frequency signals and has a so-called female terminal shape. The dielectric 3 which accommodates the inner conductor terminal 2 is made of a resin insulating member having a predetermined dielectric constant and provides an insulating state between the inner conductor terminal 2 and the outer conductor terminal 4. As shown in FIGS. 1A and 1B, the inner conductor terminal 2 is inserted into the dielectric 3 from the behind and is secured.

The outer conductor terminal 4 is formed in a substantially cylindrical shape by bending a conductive plate material and is connected to the shielded conductor Wd of the coaxial cable W to electromagnetically shield the inner conductor terminal 2. A main section 4*a* having a cylindrical shape of the outer conductor terminal 4 can accommodate the dielectric 3 inside. Behind the main section 4*a* of the outer conductor terminal 4, a crimp section 5 is arranged to which the crimping process is applied. The crimp section 5 is provided with a pair of shielded conductor crimping portions 6 and 7 extending upward and a pair of sheath crimping portions 8 and 9 similarly extending upward.

As shown in FIGS. 1A and 1B, the shielded conductor crimping portions 6 and 7 are in a strip shape and extend upward from the bottom of the crimp section 5. In the center of the left shielded conductor crimping portion 6, an oblong hole 6*a* is formed which opens along the longitudinal direction of the shielded conductor crimping portion 6. Additionally, a V-groove 6*b* is formed on the inner surface near the tip of the left shielded conductor terminal crimping portion 6. By forming the oblong hole 6*a* and the V-groove 6*b* on the left shielded conductor terminal crimping portion 6, mechanical strength against bending of the left shielded conductor terminal crimping portion 6 is made smaller than mechanical strength against bending of the right shielded conductor terminal crimping portion 7. Accordingly, when the left shielded conductor crimping portion 6 comes into contact with the right shielded conductor terminal crimping portion 7 in the crimping process, the left shielded conductor terminal crimping portion 6 bends to go under the right shielded conductor terminal crimping portion 7. The oblong hole 6*a* formed in the shielded conductor crimping portion 6 also increases fixing strength with the shielded conductor Wd because the shielded conductor Wd is pressed into the oblong hole 6*a*.

Figure 4A:
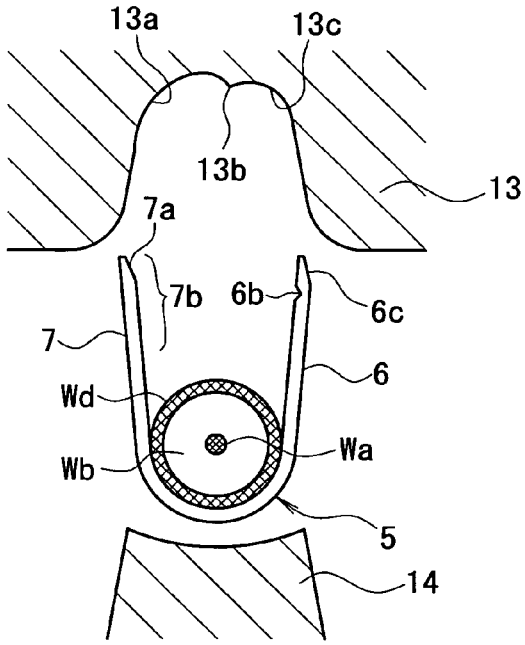
FIGS. 4A-4D are views showing in sequence an A-A section shown in FIG. 3A in several stages of the crimping process of the shielded conductor crimping portions.
Figure 4B:
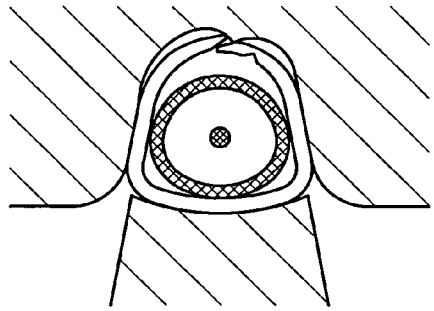

Additionally, on the outer surface at the tip of the shielded conductor crimping portion 6, a tapered surface 6*c* is formed. The tapered surface 6*c* slides along a tapered surface 7*a* of the shielded conductor crimping portion 7 in the crimping process as shown in FIGS. 4A and 4B. When the left shielded conductor crimping portion 6 comes into contact with the right shielded conductor crimping portion 7 in the crimping process, the shielded conductor crimping portion 6 is thus easily guided inward.

Further, on the inner surface at the tip of the right shielded conductor crimping portion 7, the tapered surface 7*a* is formed. The tapered surface 7*a* slides along the tapered surface 6*c* of the shielded conductor crimping portion 6 in the crimping process as shown in FIGS. 4A and 4B. When the left shielded conductor crimping portion 7 comes into contact with the right shielded conductor crimping portion 6 in the crimping process, the left shielded conductor crimping portion 7 is thus easily guided outward.

The crimp section 5 arranged in the middle between the shielded conductor crimping portions 6 and 7 has an oblong hole 5*a* opening along the longitudinal direction of the shielded conductor crimping portions 6 and 7. The shielded conductor Wd is pressed into the oblong hole 5*a* in the crimping process, thereby increasing fixing strength between the crimp section 5 and the shielded conductor Wd.

Figure 5A:
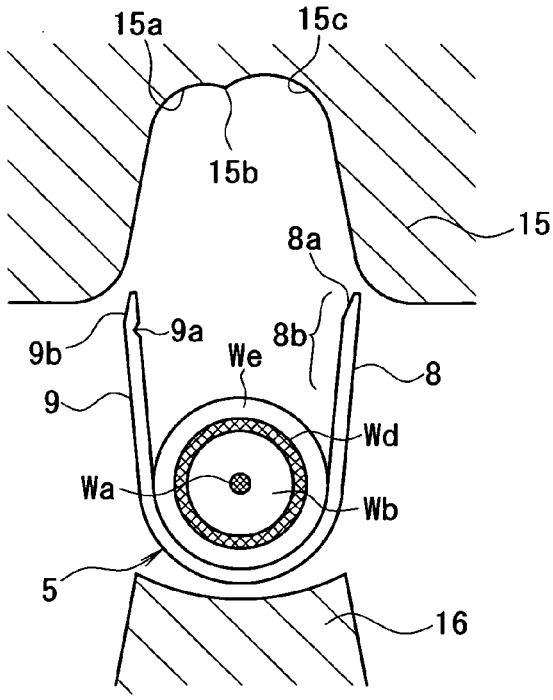
FIGS. 5A-5D are views showing in sequence a B-B section shown in FIG. 3A in several stages of the crimping process of the sheath crimping portions.
Figure 5B:
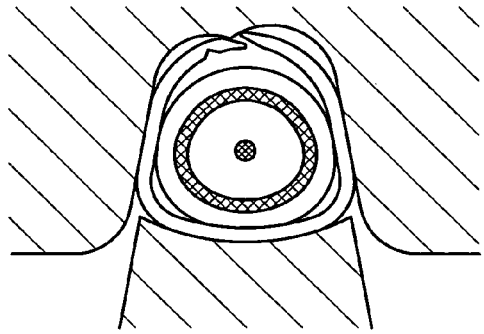

As shown in FIGS. 1A and 1B, the sheath crimping portions 8 and 9 are in a strip shape and extend upward from the bottom of the crimp section 5. On the inner surface at the tip of the left sheath crimping portion 8, a tapered surface 8*a* is formed. The tapered surface 8*a* slides along a tapered surface 9*b* of the sheath crimping portion 9 in the crimping process as shown in FIGS. 5A and 5B. When left the sheath crimping portion 8 comes into contact with the right sheath crimping portion 9, the left sheath crimping portion 8 is thus easily guided outward.

A V-groove 9*a* is formed on the inner surface near the tip of the right sheath crimping portion 9. By forming the V-groove 9*a* on the right sheath crimping portion 9, mechanical strength against bending of the right sheath crimping portion 9 is made smaller than mechanical strength against bending of the left sheath crimping portion 8. Accordingly, when the right sheath crimping portion 9 comes into contact with the left sheath crimping portion 8 in the crimping process, the right sheath crimping portion 9 bends to go under the left sheath crimping portion 8.

Additionally, on the outer surface at the tip of the sheath crimping portion 9, the tapered surface 9*b* is formed. The tapered surface 9*b* slides along the tapered surface 8*a* of the sheath crimping portion 8 in the crimping process as shown in FIGS. 5A and 5B. When the sheath crimping portion 9 comes into contact with the sheath crimping portion 8 in the crimping process, the sheath crimping portion 9 is thus easily guided inward.

The crimp section 5 arranged in the middle between the sheath crimping portions 8 and 9 has an oblong hole 5*b* opening along the longitudinal direction of the sheath crimping portions 8 and 9. The sheath We is pressed into the oblong hole 5*b* in the crimping process, thereby increasing fixing strength between the crimp section 5 and the sheath We.

The inner surfaces of the shielded conductor crimping portions 6 and 7 and the inner surfaces of the sheath crimping portions 8 and 9 are provided with reticulated knurling grooves 10 and 11 respectively.

Figure 2A:
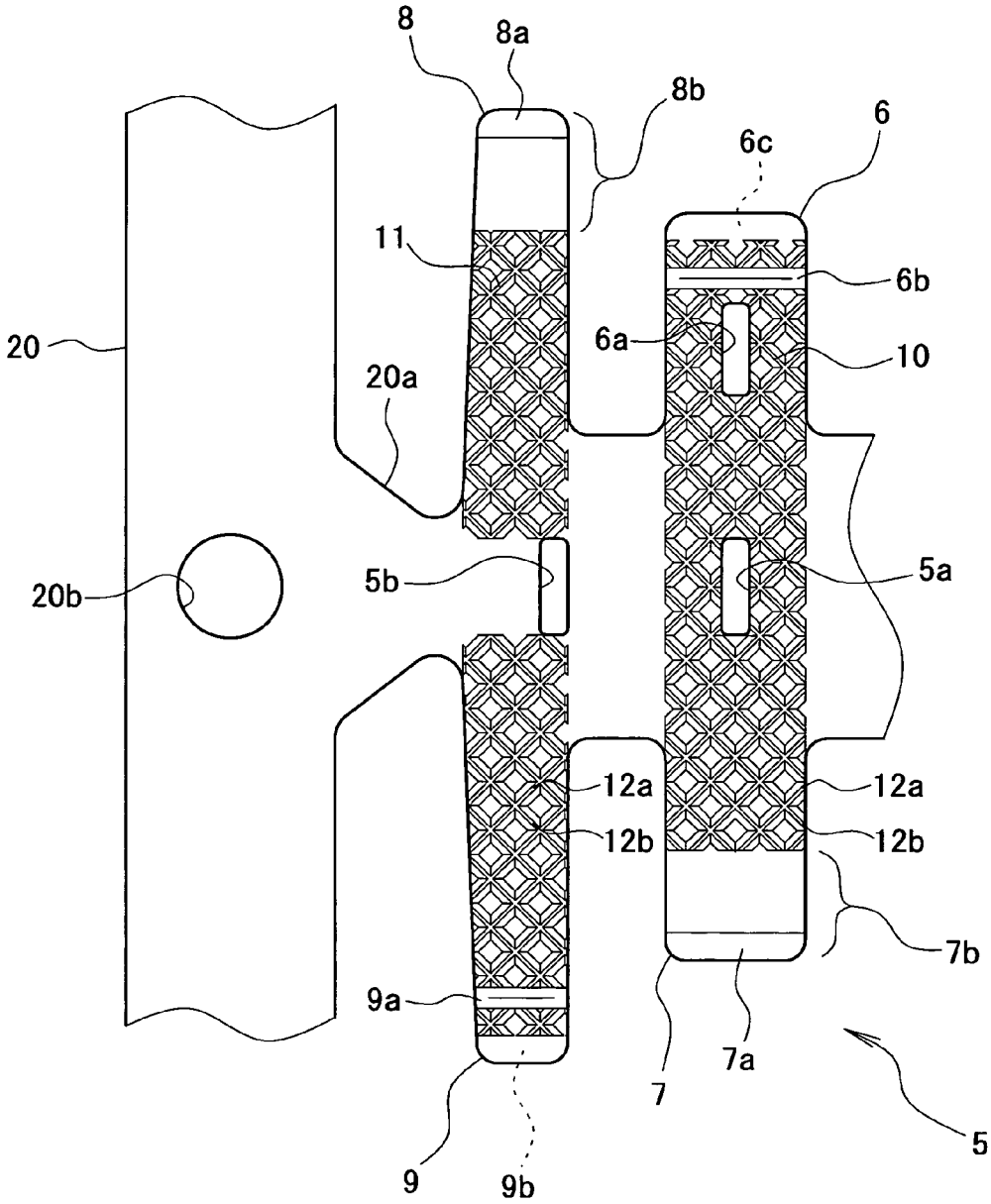
FIG. 2A is a view showing a crimp section of the outer conductor terminal shown in FIGS. 1A and 2A in a developed state before the outer conduct terminal is subjected to a bending process.

FIG. 2A shows the crimp section 5 in a developed state before the outer conductor terminal 4 is subjected to the bending process. Until the crimping process to the coaxial cable W is completed, the outer conductor terminal 4 is one of a plurality of terminals coupled to a lead frame 20 and becomes separated from the lead frame 20 by cutting a coupling section 20*a* after the crimping process is completed. A positioning hole 20*b* formed in the lead frame 20 is used to sequentially move the outer conductor terminal 4 for the bending process of the outer conductor terminal 4 and the crimping process to the coaxial cable W.

As shown in FIG. 2A, the reticulated knurling grooves 10 and 11 are each made up of diagonal concave grooves 12*a* rising from bottom left to top right in which a plurality of concave grooves in the shape of a rising diagonal line (from bottom left to top right) are arranged in parallel at a predetermined angle with respect to the axial direction of the outer conductor terminal 4, and diagonal concave grooves 12*b* falling from top left to bottom right intersecting with the diagonal concave grooves 12*a* in which a plurality of concave grooves in the shape of a falling diagonal line (from top left to bottom right) are arranged in parallel at a predetermined angle with respect to the axial direction of the outer conductor terminal 4. As shown in FIG. 2A, the reticulated knurling grooves, which are made up of the diagonal concave grooves 12*a* and diagonal concave grooves 12*b*, consist of many rhombuses.

Figure 2B:
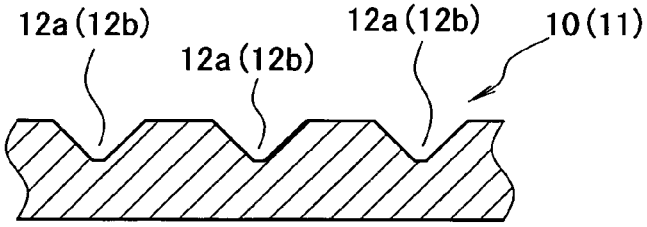
FIG. 2B is a sectional view of reticulated knurling grooves formed on the inner surface of the crimp section shown in FIG. 2A.

The reticulated knurling grooves 10 and 11 can be formed by applying press work to the developed crimp section 5 using a stamping die having convex threads which correspond to the shape of the grooves. As shown in FIG. 2B, the reticulated knurling grooves 10 and 11 (the diagonal concave grooves 12*a* and the diagonal concave grooves 12*b*) each have a flat bottom and tapered side walls, and thus the upper sides of the concave grooves are wider. The depth and width of the reticulated knurling grooves 10 and 11 are such that the elemental wires of the braid defining the shielded conductor Wd can be pressed into the grooves.

On an overlapping portion 7*b* of the inner surface of the shielded conductor crimping portion 7 which is placed on the shielded conductor crimping portion 6, the reticulated knurling grooves 10 are not formed as shown in FIG. 2A. While the reticulated knurling grooves 10 formed on the substantially entire inner surface of the shielded conductor crimping portion 6 come into contact with the shielded conductor Wd and increase the fixing strength, the overlapping portion 7*b* of the shielded conductor crimping portion 7 does not come into contact with the shielded conductor Wd because it is placed on top of the shielded conductor crimping portion 6 and thus does not contribute to improvement in the fixing strength. Accordingly, by not forming the reticulated knurling grooves 10 on the overlapping portion 7*b*, the area of the reticulated knurling grooves 10 can be decreased without decreasing the fixing strength with the shielded conductor Wd.

Additionally, on a portion of the inner surface of the shielded conductor crimping portion 6 which corresponds to the tapered surface 6*c* of the outer surface, the reticulated knurling grooves 10 are not formed as shown in FIG. 2A. Even if the reticulated knurling grooves 10 are formed on this portion, they do not improve the fixing strength by coming into contact with the shielded conductor Wd, because the tapered surface 6*c* is formed by applying press work on the outer surface and any reticulated knurling grooves 10 formed on the portion of the inner surface which corresponds to the tapered surface 6*c* of the outer surface become flat in the press work. Accordingly, by not forming the reticulated knurling grooves 10 on the portion which corresponds to the tapered surface 6*c*, the area of the reticulated knurling grooves 10 can be decreased without decreasing the fixing strength with the shielded conductor Wd.

In addition, on an overlapping portion 8*b* of the inner surface of the sheath crimping portion 8 which is placed on the sheath crimping portion 9, the reticulated knurling grooves 11 are not formed as shown in FIG. 2A. While the reticulated knurling grooves 11 formed on the substantially entire inner surface of the sheath crimping portion 9 come into contact with the sheath We and increase the fixing strength, the overlapping portion 8*b* of the sheath crimping portion 8 does not come into contact with the sheath We because it is placed on top of the sheath crimping portion 9 as shown in FIGS. 3B and 5D and thus does not contribute to improvement in the fixing strength. Accordingly, by not forming the reticulated knurling grooves 11 on the overlapping portion 8*b*, the area of the reticulated knurling grooves 11 can be decreased without decreasing the fixing strength with the sheath We.

Further, on a portion of the inner surface of the sheath crimping portion 9 which corresponds to the tapered surface 9*b* on the outer surface, the reticulated knurling grooves 11 are not formed as shown in FIG. 2A. Even if the reticulated knurling grooves 11 are formed on this portion, they do not improve the fixing strength by coming into contact with the sheath We, because the tapered surface 9*b* is formed by applying press work on the outer surface and any reticulated knurling grooves 11 formed on the portion of the inner surface which corresponds to the tapered surface 9*b* of the outer surface become flat in the press work. Accordingly, by not forming the reticulated knurling grooves 11 on the portion which corresponds to the tapered surface 9*b*, the area of the reticulated knurling grooves 11 can be decreased without decreasing the fixing strength with the sheath We.

By forming the reticulated knurling grooves 11 on the inner surfaces of the sheath crimping portions 8 and 9 of the outer conductor terminal 4 as described above, it is possible to substantially evenly disperse stress, which is caused when the sheath crimping portions 8 and 9 are crimped onto the sheath We of the coaxial cable W, on the inner surfaces of the sheath crimping portions 8 and 9. Accordingly, change in characteristic impedance caused by cross-sectional deformation of the insulator Wb which is arranged inside the sheath We can be suppressed, and the fixing strength can be increased due to increased contact between the sheath We and the sheath crimping portions 8 and 9. As a result, resistance of the coaxial cable W against being pulled out from the sheath crimping portions 8 and 9 can be improved.

Figure 3A:
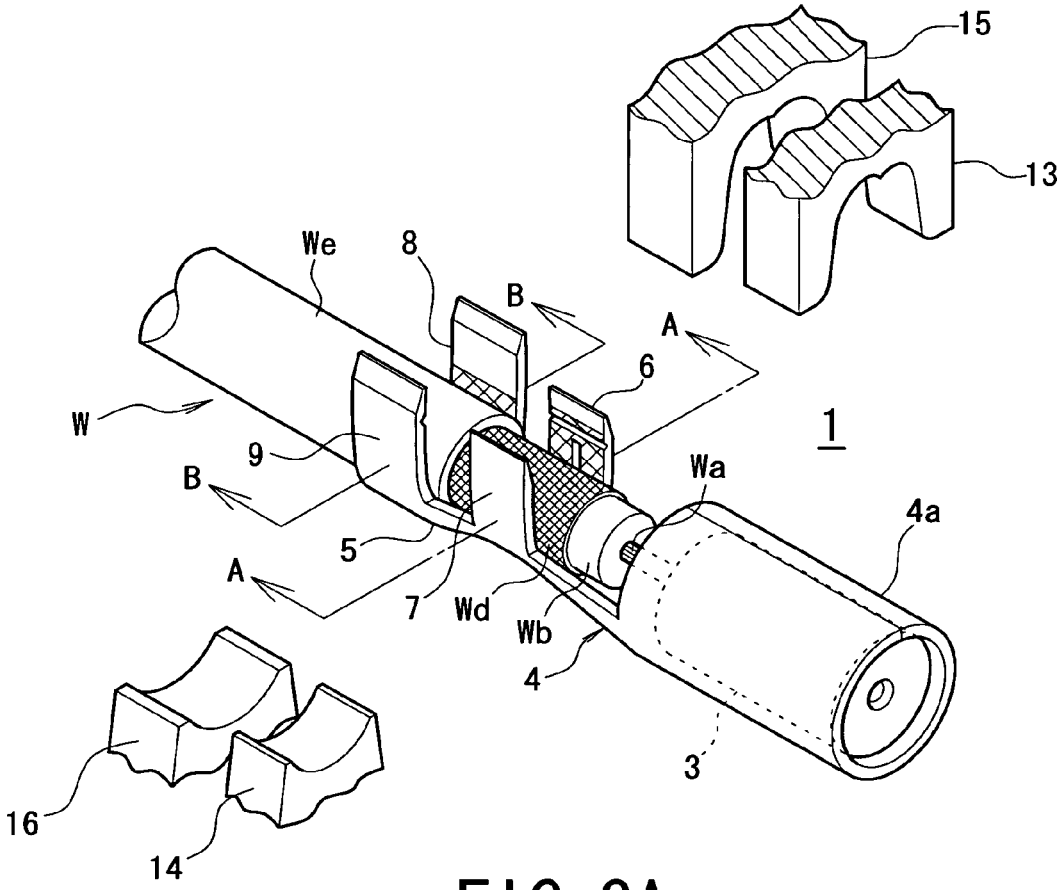
FIG. 3A is an external perspective view of the shielded connector viewed from the front before it is subjected to a crimping process using a crimper and an anvil for shield conductor crimping portions and a crimper and an anvil for sheath crimping portions.
Figure 3B:
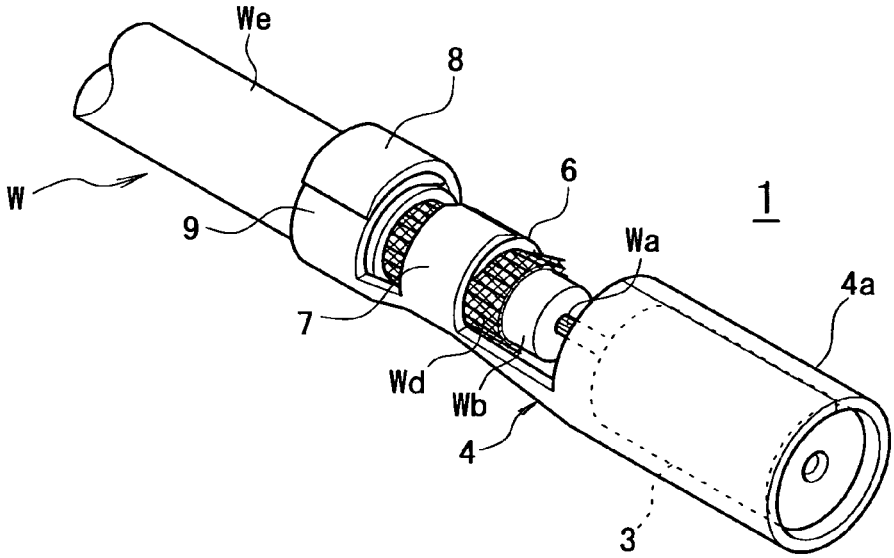
FIG. 3B is an external perspective view of the shielded connector after it is subjected to the crimping process.

FIG. 3A is an external perspective view of the shielded connector 1 viewed from the front before it is subjected to the crimping process using a crimper 13 and an anvil 14 for the shield conductor crimping portions and a crimper 15 and an anvil 16 for the sheath crimping portions, and FIG. 3B is an external perspective view of the shielded connector 1 after it is subjected to the crimping process. As shown in FIG. 3A, the coaxial cable W whose shielded conductor Wd and sheath We are stripped for predetermined lengths is placed on the crimp section 5 having the shielded conductor crimping portions 6 and 7 and the sheath crimping portions 8 and 9. The crimper 13 is arranged above the shielded conductor crimping portions 6 and 7 and the shielded conductor Wd, while the anvil 14 is placed below the shielded conductor crimping portions 6 and 7. Additionally, the crimper 15 is arranged above the sheath crimping portions 8 and 9 and the sheath We, while the anvil 16 is placed below the sheath crimping portions 8 and 9.

FIGS. 4A-4D show in sequence an A-A section shown in FIG. 3A in several stages of the crimping process of the shielded conductor crimping portions 6 and 7, and FIGS. 5A-5D show in sequence a B-B section shown in FIG. 3A in several stages of the crimping process of the sheath crimping portions 8 and 9.

As shown in FIG. 4A, the inner wall of the crimper 13 for the shielded conductor crimping portions has a left-right asymmetrical shape which looks like a range of two mountains having different heights. The crimper 13 has a deep depression 13*a* on the left, a protrusion 13*b* near the center where two depressions meet, and a shallow depression 13*c* on the right. The right and left shielded conductor crimping portions 6 and 7 bend with different timings because the crimper 13 is configured as above. This prevents the tips of the shielded conductor crimping portions 6 and 7 from colliding against each other in the crimping process and causing crimp failure.

As shown in FIG. 5A, the inner wall of the crimper 15 for the sheath crimping portions has a left-right asymmetrical shape which looks like a range of two mountains having different heights. The crimper 15 has a shallow depression 15*a* on the left, a protrusion 15*b* near the center where two depressions meet, and a deep depression 15*c* on the right. The right and left sheath crimping portions 8 and 9 bend with different timings because the crimper 15 is configured as above. This prevents the tips of the sheath crimping portions 8 and 9 from colliding against each other in the crimping process and causing crimp failure.

As shown in FIG. 4B, when the crimper 13 moves downward from above the shielded conductor crimping portions 6 and 7 and the shielded conductor Wd of the coaxial cable W, first the right shielded conductor crimping portion 6 comes into contact with the shallow depression 13*c* of the crimper 13 and then starts to bend inward along the shallow depression 13*c*. As the crimper 13 continues to move downward, the left shielded conductor crimping portion 7 comes into contact with the deep depression 13*a* of the crimper 13 and then starts to bend inward along the deep depression 13*a*. Because of the tapered surface 7*a* formed on the inner surface at the tip of the shielded conductor crimping portion 7 and the tapered surface 6*c* formed on the outer surface at the tip of the shielded conductor crimping portion 6, when the shielded conductor crimping portions 6 and 7 come into contact with each other, the shielded conductor crimping portion 6 is guided inward and the shielded conductor crimping portion 7 is guided outward.

Meanwhile, as shown in FIG. 5B, when the crimper 15 moves downward from above the sheath crimping portions 8 and 9 and the sheath We of the coaxial cable W, first the left sheath crimping portion 9 comes into contact with the shallow depression 15*a* of the crimper 15 and then starts to bend inward along the shallow depression 15*a*. As the crimper 15 continues to move downward, the right sheath crimping portion 8 comes into contact with the deep depression 15*c* of the crimper 15 and then starts to bend inward along the deep depression 15*c*. Because of the tapered surface 9*b* formed on the outer surface at the tip of the left sheath crimping portion 9 and the tapered surface 8*a* formed on the inner surface at the tip of the right sheath crimping portion 8, when the sheath crimping portions 8 and 9 come into contact with each other, the sheath crimping portion 9 is guided inward and the sheath crimping portion 8 is guided outward.

Figure 4C:
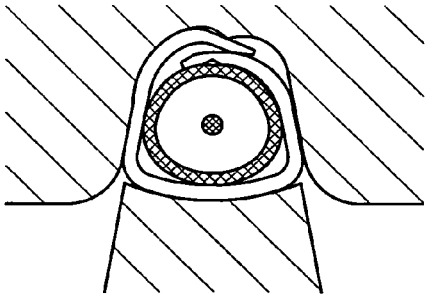
Figure 4D:
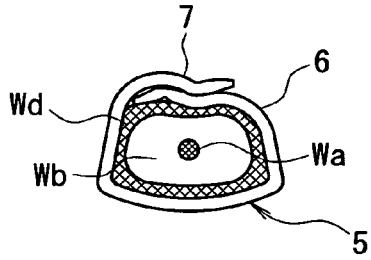

As shown in FIG. 4C, the tip of the right shielded conductor crimping portion 6, which starts to bend before the shielded conductor crimping portion 7, is guided downward by the projection 13*b* arranged near the center of the crimper 13. The tip of the left shielded conductor crimping portion 7, which starts to bend after the shielded conductor crimping portion 6, bends such that it is placed on the right shielded conductor crimping portion 6. When the crimping process is completed, the tip of the right shielded conductor crimping portion 6 is placed under the left shielded conductor crimping portion 7 and the tip of the left shielded conductor crimping portion 7 is placed on the shielded conductor crimping portion 6 as shown in FIG. 4D.

Figure 5C:
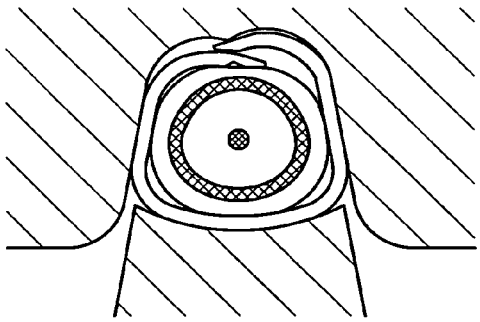
Figure 5D:
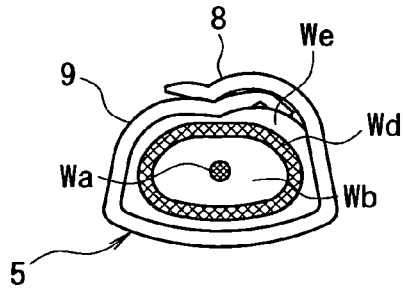

Meanwhile, as shown in FIG. 5C, the tip of the left sheath crimping portion 9, which starts to bend before the sheath crimping portion 8, is guided downward by the projection 15*b* arranged near the center of the crimper 15. The tip of the right sheath crimping portion 8, which starts to bend after the sheath crimping portion 9, bends such that it is placed on the left sheath crimping portion 9. When the crimping process is completed, the tip of the left sheath crimping portion 9 is placed under the right sheath crimping portion 8 and the tip of the right sheath crimping portion 8 is placed on the sheath crimping portion 9 as shown in FIG. 5D.

As described above, the area on which the reticulated knurling grooves 10 are formed is decreased by the area of the overlapping portion 7*b* as compared with when the reticulated knurling grooves 10 are formed on the entire inner surfaces of the shielded conductor crimping portions 6 and 7 as with a conventional art. Similarly, as compared with when the reticulated knurling grooves 11 are formed on the entire inner surfaces of the sheath crimping portions 8 and 9, the area on which the reticulated knurling grooves 11 are formed is decreased by the area of the overlapping portion 8*b*. Accordingly, it is possible to suppress an increase in the cost of a die used in press work to form the reticulated knurling grooves on the crimping portions, and to decrease pressing pressure in the press work, thereby producing favorable effects such as better uniformity in the shape of the reticulated knurling grooves which result in improved productivity. In addition, occurrence of a burr can be suppressed in portions such as the tips of the shielded conductor crimping portions.

In addition, in the foregoing preferred embodiment of the present invention, the areas of the reticulated knurling grooves 10 and 11 are further decreased by the areas of the tapered surfaces 6*c* and 9*b*. By not forming the reticulated knurling grooves 10 and 11 on the portions which correspond to the tapered surfaces 6*c* and 9*b*, when the tapered surfaces 6*c* and 7*a* at the tips of the shielded conductor crimping portions 6 and 7 come into contact with each other and the tapered surfaces 8*a* and 9*b* at the tips of the sheath crimping portions 8 and 9 come into contact with each other, they can smoothly slide without being caught. Accordingly, productivity in the crimping process can be improved.

The present invention is not limited to the preferred embodiment of the present invention described above, and variations may be made within the scope of the intension of the present invention. For example, the present invention is applied to the coaxial cable W which has one signal wire comprising the conductor Wa and the insulator Wb covering the conductor Wa in the foregoing preferred embodiment, but the present invention is also applicable to a multi-contact shielded cable having a plurality of such signal cables, and the number of the signal cables is not limited.

The invention claimed is:

1. An outer conductor terminal of a shielded connecter that is connected to an end of a shielded cable having a shielded conductor that covers an outer surface of a signal wire and a sheath that covers an outer surface of the shielded conductor, the outer conductor terminal comprising:

upper and lower shielded conductor crimping portions arranged to be crimped onto the shielded conductor that is exposed by stripping the sheath at the end of the shielded cable, wherein the shielded conductor crimping portions are crimped such that the upper shielded conductor crimping portion overlaps the lower shielded conductor crimping portion, upper and lower shielded conductor crimping portions arranged to be crimped onto the shielded conductor that is exposed by stripping the sheath at the end of the shielded cable, wherein a crimp section is arranged in a middle between the upper and lower shielded conductor crimping portions and has an opening along a longitudinal direction of the upper and lower shielded conductor crimping portions, and the shielded conductor crimping portions are crimped such that the upper shielded conductor crimping portion overlaps the lower shielded conductor crimping portion;

wherein a tapered surface is formed on an outer surface at a tip of the lower shielded conductor crimping portion, and reticulated knurling grooves are formed on all of an inner surface of the lower shielded conductor crimping portion other than a portion that corresponds to the tapered surface on the outer surface at the tip of the lower shielded conductor crimping portion, and reticulated knurling grooves are formed on an inner surface of the upper shielded conductor crimping portion other than a portion that is placed on the lower shielded conductor crimping portion, and a tapered surface that can slide on the tapered surface on the outer surface of the lower shielded conductor crimping portion is formed on the inner surface of the upper shielded conductor crimping portion other than a portion on which the reticulated knurling grooves are formed.

2. The outer conductor terminal according to claim 1, further comprising:

upper and lower sheath crimping portions arranged to be crimped onto the sheath, wherein the upper and lower sheath crimping portions are crimped such that the upper sheath crimping portion overlaps the lower sheath crimping portion; and reticulated knurling grooves formed on inner surfaces of the upper and lower sheath crimping portions, wherein the reticulated knurling grooves are formed on all of the inner surface of the lower sheath crimping portion and on all of the inner surface of the upper sheath crimping portion other than a portion which is placed on the lower sheath crimping portion.

3. The outer conductor terminal according to claim 2, further comprising:

a tapered surface formed on an outer surface at a tip of the lower sheath crimping portion; and a tapered surface formed on an inner surface at a tip of the upper sheath crimping portion, which can slide on the tapered surface of the lower sheath crimping portion, wherein the reticulated knurling grooves are formed on all of the inner surface of the upper sheath crimping portion other than a portion that corresponds to the tapered surface of the outer surface of the lower sheath crimping portion.

* * * * *